US008336361B2

(12) United States Patent
Fahrenbach

(10) Patent No.: US 8,336,361 B2
(45) Date of Patent: Dec. 25, 2012

(54) EMBOSSING METHOD AND APPARATUS FOR PRODUCING DIFFRACTION-ACTIVE STRUCTURES

(75) Inventor: Jürgen Fahrenbach, Aichelberg (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 613 days.

(21) Appl. No.: 12/584,916

(22) Filed: Sep. 15, 2009

(65) Prior Publication Data

US 2010/0294015 A1 Nov. 25, 2010

(30) Foreign Application Priority Data

May 18, 2009 (DE) ..... 10 2009 021 880

(51) Int. Cl.
*B21D 17/02* (2006.01)

(52) U.S. Cl. ..... 72/414; 283/72; 283/67

(58) Field of Classification Search ..... 72/462, 72/467, 324, 379.2, 414, 474, 475, 46, 47, 72/363, 700; 283/67, 70, 90, 113
See application file for complete search history.

(56) References Cited

U.S. PATENT DOCUMENTS

| | | | | |
|---|---|---|---|---|
| 2,900,992 | A * | 8/1959 | Johnson | 134/122 R |
| 6,834,525 | B2 * | 12/2004 | Leon et al. | 72/385 |
| 7,156,926 | B2 * | 1/2007 | Voges | 134/9 |
| 2004/0221639 | A1 * | 11/2004 | Woo et al. | 72/370.04 |
| 2006/0151989 | A1 * | 7/2006 | Muke et al. | 283/67 |

FOREIGN PATENT DOCUMENTS

| | | | |
|---|---|---|---|
| DE | 197 22 575 | | 12/1998 |
| DE | 197 22 575 | A1 | 12/1998 |
| DE | 100 02 644 | A1 | 8/2001 |
| DE | 100 20 644 | | 8/2001 |
| WO | 2004/045866 | A1 | 6/2004 |
| WO | WO 2004/045866 | | 6/2004 |

* cited by examiner

*Primary Examiner* — Dana Ross
*Assistant Examiner* — Matthew G Katcoff
(74) *Attorney, Agent, or Firm* — Klaus J. Bach

(57) ABSTRACT

In an apparatus and a method for producing diffraction- and interference-active structures by micro-pattern stamping a metal object, a micro-stamping arrangement is provided including a micro-stamping station with a micro-pattern stamp for generating a diffraction-active structure on the metal object, an application station for applying a protective layer to the diffraction-active structure and a macro-stamping station for applying a macroscopic image relief over the diffraction active structure while it is protected by the protective layer.

7 Claims, 1 Drawing Sheet

EMBOSSING METHOD AND APPARATUS FOR PRODUCING DIFFRACTION-ACTIVE STRUCTURES

BACKGROUND OF THE INVENTION

The invention resides in an apparatus and a method for producing light diffraction-active structures on workpieces by way of embossing or stamping.

For generating colorful optical effects, such as holograms or similar on metal surfaces, for example on coins, it is known to provide the surface of the particular object with a diffraction-active surface structure. Such a surface structure causes light interferences which generate the desired optical effect. Diffraction-active surfaces are not provided only for decoration purposes, but they may also prevent falsifications. The optical effect is based on very fine, periodic relief-like lattice structures which are embossed into the respective surface. The best known example is found in metallized plastic foils with holograms used on charge cards and money bills and on seals. While a smooth surface reflects incident angles, different reflection angles are obtained in connection with diffraction lattice structures which results for example on hologram foils. The manufacture of diffraction-active foils is based on the embossing of the thermoplastic materials by galvanically formed nickel stamps and subsequent metallization of the lattice surface. In addition, there are other methods by which diffraction lattice structures can be applied directly to the surfaces of metallic bodies.

WO 2004/045866 A1 discloses for example a way for generating such surface structures on metal surfaces of workpieces by means of an embossing stamp. The stamp includes a lattice and/or line structure which is formed onto the workpiece during the embossing of the workpiece. Herein, the embossment stamp is formed by a monocrystalline diamond which is soldered by cobalt to a substrate body. The negative structure of the infraction lattice structure to be formed is machined into the embossment stamp by means of a laser. In addition, the embossment stamp may be polished by an electron beam or x-ray treatment.

With this process however, the size of the interference active structures to be generated is limited to the size of the diamonds that are available.

In addition, DE 100 02 644 A1 discloses the manufacture of diffraction active relief structures on coin surfaces. To this end, the respective semi-finished workpiece is first coded in an immersion bath with a thin light-sensitive plastic foil. Then the plastic foil is exposed to light and is developed. In this way, microscopically fine spots on the coin surface are exposed. In an etching bath, thin microscopic relief structures are then etched into the coin surface, whereupon the light sensitive plastic is again removed. The DE 100 644 A1 discloses furthermore a concept for a counterfeit-proof coin with diffraction optical features which complement the conventional design elements of a coin. These should be visually recognizable but also machine-readable, wherein the machine recognition of the infraction optical signature is based on the deformation of the spatial position of the diffraction maxima. A reading apparatus is presented which is installed in coin examination devices and similar apparatus. The core of this reading apparatus is a light source and a sensor arrangement tuned thereto by which it is determined, among others, whether the diffraction maxima of the light reflected from the signature on the coin occur at the location as expected based on the wavelength of the light and the lattice parameters of the structure.

Further, DE 197 22 575 A1 discloses the manufacture of interference-capable microstructures, for example, for the generation of holograms on coins or such structures by means of embossing stamps. In this method, several hard layers consisting for example of cobalt- or nickel alloys are deposited into which diamond crystals are embedded. The layers may be deposited by special alloy both immersion bathes and metal spray processes, by galvanic deposition or by plasma deposition. The surface layer is formed by a diamond-like layer, which contains the microstructure. For generating the microstructures, the above reference refers generally to galvanic processes, electronic or laser engraving, fine etching techniques and direct engraving by diamond tools.

But it is still difficult on one hand, to produce macroscopic relief structures as they are common in connection with coins and, on the other hand, diffraction structures.

It is therefore the object of the present invention to provide a practical method and a corresponding arrangement for the technical manufacture of diffraction structures by embossing techniques as well as relief structures on metal surfaces. It is particularly an object of the invention to provide a practically useable cost effective manufacturing procedure for diffractograms embossed into metal for use in the mass production of circulation coins and tokens or, respectively, value stamps, but also for the manufacture of special coins, medallions, and similar items.

SUMMARY OF THE INVENTION

In an apparatus and a method for producing diffraction- and interference-active structures by micro-pattern stamping a metal object, a micro-stamping arrangement is provided including a micro-stamping station with a micro-pattern stamp for generating a diffraction-active structure on the metal object, an application station for applying a protective layer to the diffraction-active structure and a macro-stamping station for applying a macroscopic relief image over the diffraction active structure protected by the protective layer.

The embossment arrangement according to the invention is designed for use in the manufacture of metal objects, such as coins. The micro-embossment station is adapted to provide on a massive metallic object a surface with a diffraction-active structure. The diffraction-active structure may be a point or line pattern with raised areas and depressions on the surface of the metallic object. The size of these structures is in the area of the wavelength of the light, so that diffractions and interferences can occur. The light interference generates colorful surface areas. After the micro-embossment station, the object passes through a coating arrangement in which a protective layer is applied to the infraction-active structure. This protective coating fills the infraction-active structures and covers them. A protective layer of mineral oils, silicon oils, lacquers, paints, plastic materials such as duromers, elastomers, solutions of inorganic or organic materials, aqueous solutions etc., may be used. The object coated with the protective layer is then supplied to an embossment station in which a macroscopic relief image is applied. This relief image may extend over the area previously embossed in the micro-embossment station. The diffraction active structure may remain unchanged in this process or it may also be deformed. For example, it may be provided with a concave or convex curvature. In addition, macroscopic line structures or other geometric elements extending through the diffraction-active structure may be produced. With the protective layer, the diffraction-active structures are maintained, that is, they are not, or only minimally damaged. In this way, metal objects can be manufactured, such as coins, which have a macroscopic relief as it is common with coins, wherein the earlier-produced diffraction-active structures are integrated. As a result, metal coins can be manufactured with different color effects. The color effects are generated by interference of the reflecting light at the diffraction-active structures.

The diffraction-active structures can be used as authenticity feature. But they may also be used for other purposes for example age or wear indicators as the diffraction activity disappears slowly with the wear of the diffraction-active structure for example by extensive handling of the coin.

The protective layer may be removed after the establishment of the macroscopic relief so that the diffraction-active structure is exposed. In this case, the protective layer can be formed by an opaque material. But it is also possible to apply a protective layer of transparent material which is not removed after completion of the coin or other metal object. If the material of the protective layer has a diffraction index which differs from that of air, the diffraction-active structure may generate—as long as the protective layer is present—colors which are different from those generated after the removal or wear of the protective layer. In this way, the respective objects may be provided with—so to speak—a clock or an expiration date. If, with the use of the object the protective layer peels off after a certain time of use, there will be a color change at the infraction-active structure which then indicates the reaching of the expiration date.

The micro-embossment stamp consists preferably of a high-strength hard carrier material such as a hard metal. On the micro-embossment stamp, a hard material layer may be deposited which has a micro-embossment relief pattern for generating the diffraction-active structures in the form of diffraction-active embossment areas on the object which consists preferably of a metal. The hard material layer is preferably a DLC-layer (DLC stands for Diamond Like Carbon, that is, a carbon which is similar to Diamond).

The size of the micro-embossment stamp may differ from the size of the embossment stamp of the macro-embossment station. In this way, it is possible to produce in an embossment image several smaller micro-embossed diffraction-active structures. The micro-embossment locations and the macro-embossment locations may be so arranged that they fully overlap. But also a partial overlapping may be provided or overlapping of the structures may be avoided.

The micro-embossment station is generally provided with a cleaning arrangement which keeps the micro-stamp clean. This may be achieved by occasional direct cleaning of the micro-stamp die and/or by cleaning of the object supplied to the micro-stamping station. As cleaning arrangement, preferably a particle jet cleaning arrangement is provided, which may include gas discharge nozzles by which a particle jet can be directed onto the stamping relief of the micro-stamp die and/or the metal object. As particle jet, a dry ice particle jet is particularly suitable. Alternatively, brushes or other mechanical cleaning arrangements may be used which cooperate with the micro-stamping die.

The arrangement according to the invention includes an application arrangement for the protective layer, which, preferably, is in the form of a spray arrangement. The spray arrangement is disposed preferably between the micro-stamping station and the relief stamping station. The protective layer may be sprayed onto the diffraction-active stamped surface of the object, when the object is transported by a transfer arrangement through the application arrangement.

The application arrangement applies preferably a liquid protection agent which, dependent on the requirements, may remain liquid or may be cured. It protects the diffraction-active structure previously generated from destruction during the relief stamping procedure.

Further features and advantageous embodiments of the invention will become apparent from the following description of the invention on the basis of the accompanying drawings. The drawings and the description are limited to a schematic re presentation of the important aspects of the invention.

DESCRIPTION OF PARTICULAR EMBODIMENT

Figure 1:
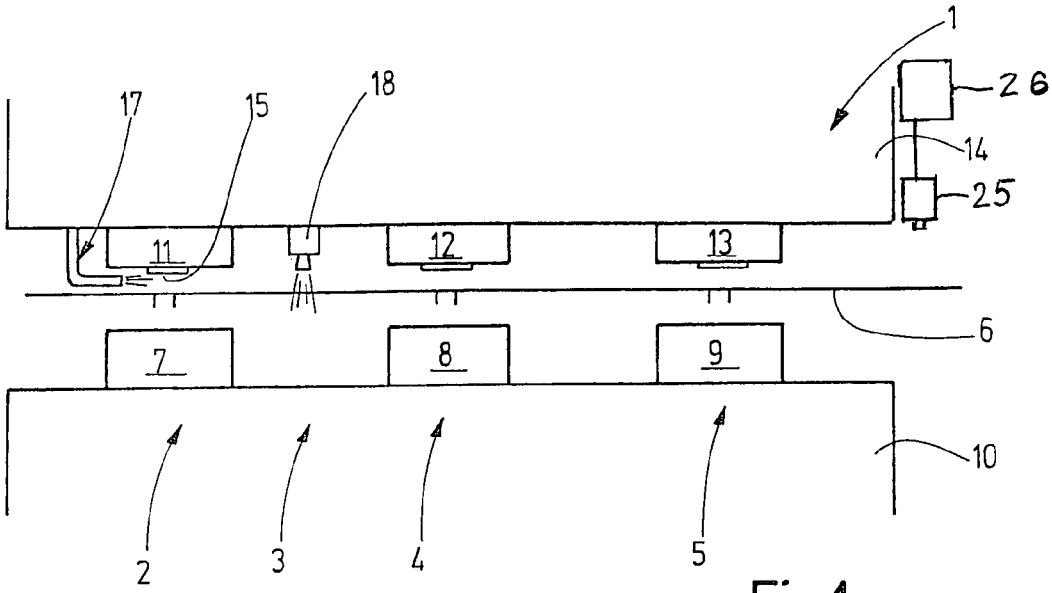
FIG. 1 shows schematically a stamping installation in the form of a press tool with various stamping stations.
Figure 6:
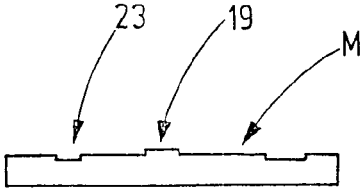
FIG. 6 shows the metal object in a schematic side view after passing the relief station.

FIG. 1 shows a stamping installation 1 which may be used for the manufacture of combination-stamped metal or other objects. Combination stamping in this connection means that the stamping image includes diffraction-active microstructures which, when illuminated generate color effects by light interference and that, in addition, macroscopic structure elements are provided as they are generally present on stamped objects such as coins. The stamping installation includes several stations, that is, a micro-stamping station 2, an application arrangement 3 and a relief stamping station 4. Furthermore, a punching station 5 may be provided. In the micro-stamping station 2, a diffraction-active structure is formed for example on a metal object such as a workpiece 6 indicated by M in FIG. 2. In the application station 3, the diffraction-active structure formed in the stamping station 2 is coated with a protective medium such as a protective liquid. In the relief stamping station 4, a macroscopic stamping pattern is applied to the metal workpiece. In the punching station 5, the edge of the metal coin is for example, punched out, if the metal workpiece is for example a coin. The metal object is moved through the stations 2-5 in series. For the transport of the workpiece, a transfer arrangement 6 may be provided for example in the form of one or several gripper devices. The transfer arrangement 6 is shown in FIG. 6 in a highly schematic way.

The micro-stamping station 2 and the relief stamping station 4 and also the optional punching station 5 may be formed by parts of a single press tool or it may include several separate press tools. The press tools may be disposed in different presses or, as it is preferred in the present case, in a single press. They have for example each a lower tool part 7, 8, 9. These tool parts are all disposed together on a common lower tool carrier 10 which may be disposed on a press table which is not shown in the drawings. Above the lower tool parts 7, 8, 9 respective upper tool parts 11, 12, 13 are arranged which are disposed on a common tool carrier 14 mounted for example on a press plunger.

The tool parts 7, 11 form the micro-stamping station 2. One of the two tool parts 7, 11 or both are provided with a micro-stamping die 15 which consists for example of hard metal with a hard material layer disposed thereon, for example a DLC layer. The DLC layer is provided with a micro engraving for example by laser ablation. This generates on the metal object M upon stamping a diffraction-active structure 16 as it is shown for example in FIG. 4. The structure 16 consists of micro-fine projections and recesses whose dimensions are of a size in the area of the light wavelength so that light reflected therefrom is subjected to diffractions and interferences. The micro-stamping station 2 preferably includes a cleaning station 17. The cleaning station 1 has for example a nozzle for producing a particle jet, for example a dry ice particle jet which is directed onto the structured front face of the micro-stamping die 15 for keeping the stamp clean. This cleaning step may be performed after each press stroke or in particular time intervals or on the basis of need.

The application station 3 arranged between the relief station 4 and the micro-stamping 2 includes for example a spray nozzle 18, which is connected to a supply unit, not shown, and which discharges a protective fluid onto a workpiece held for example on the transfer arrangement 6.

Figure 2:
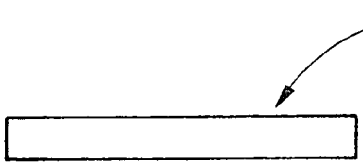
FIG. 2 shows a workpiece in a side view before its passage through the stamping installation.
Figure 3:
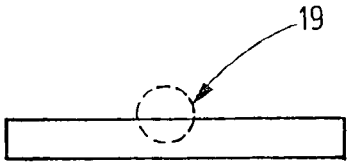
FIG. 3 shows schematically the workpiece of FIG. 2 after passage through the micro-stamping station.
Figure 4:
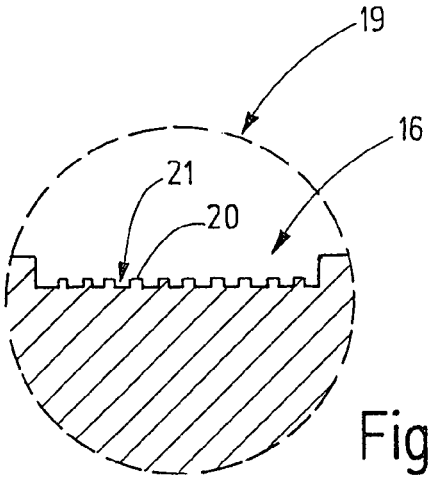
FIG. 4 shows, in an enlarged view, the diffraction-active structure formed on the metal object.

The stamping installation 1 as described above operates as follows:

First, the transfer arrangement 6 places the unfinished product M according to FIG. 2 into the stamping station 2 when the tool parts 7, 11 are open, that is, moved apart from one another. When the transfer arrangement 6 is moved out of the tool, the micro-stamping step is initiated wherein the micro-stamping stamp 15 produces on the object M a micro-engraved structure 19 as it is indicated in FIG. 3. FIG. 4 shows the micro-engraved structure 19 in an enlarged schematic representation. It includes the diffraction-active structure 16 in the form of small projections 20 and recesses 21 for example in the form of webs which have a width of half a micrometer to a few micrometers and a height of half a micrometer to a few micrometers. From incident light, the diffraction-active structure 16 generates colorful patterns with constant—or also with changing—colors dependent on the light incident direction.

Figure 5:
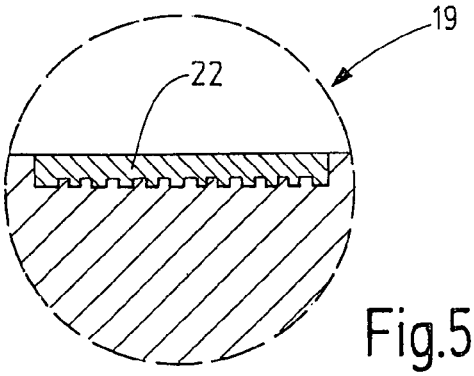
FIG. 5 shows the diffraction-active structure after application of a protective layer.

When the micro-stamping structure 19 is formed, the tool consisting of the tool parts 7, 11 opens again and the transfer arrangement 6 takes the object M out of the tool. The object M is then moved through the application station 3, that is, it is moved along below the spray nozzle 18, which at proper moment expulses a spray jet. In this way, the micro-stamped structure is filled with a protection fluid 22 as shown in FIG. 5. The protective film consists of a silicon oil, a mineral oil, a protective lacquer or a similar compound. Subsequently, the object M is transferred to at least one additional stamping procedure as it is generally used for macroscopic stamping of objects. The protective fluid 22 contained in the micro-stamped structure 19 prevents damage to, or destruction of, the micro-stamped structure 19 in the process.

FIG. 6 shows the object M after passage through the relief stamping station 4. A macroscopic stamping pattern 23 is imposed over the micro-stamped structure 19, which has been protected by the protective fluid 22 and is now embedded in the macroscopic stamping pattern. The micro-stamped pattern may become slightly deformed in the process without being destroyed however.

The present invention combines a diffraction or interference-active micro-pattern stamping of an object with the conventional macroscopic embossing of an object by first applying to the object in a micro-stamping step diffraction-active structures and subsequently the macroscopic stamping structures. After the micro-stamping step, a protective fluid is applied to the diffraction-active stamped structure which protects the micro-stamped structure during the following macro-stamping step from being damaged. The protective fluid may afterwards remain on the micro-stamped structure or it may be removed in a controlled manner. For this purpose, corresponding cleaning stations may be provided.

Preferably, also an optical sensor 25 is provided together with a control unit 26 for monitoring the manufacturing quality of the metal object M.

What is claimed is:

1. A method for applying a diffraction-active structure to a metal object comprising the steps of:

a) providing a metal object (M) and introducing the metal object into a micro-stamping station (2), b) performing a micro-stamping step for forming a diffraction-active structure (16) on the metal object (M), c) applying a protective medium layer (22) at least to the diffraction-active structure (16) formed on the metal object (M) during the micro-stamping step, d) transferring the metal object (M) to relief stamping station (4), and e) performing a macro relief pattern stamping step for generating a macroscopic relief stamping pattern (23) overlaying the diffraction-active structure (16) applied to the metal object in the micro-stamping station.

2. The method according to claim 1, wherein the protective medium layer (22) is removed from the metal object (M) after the macro relief pattern stamping step.

3. The method according to claim 1, wherein the protective medium layer (22) is hardened before or after the execution of the relief pattern stamping step.

4. The method according to claim 1, wherein the protective medium (22) consists of one of silicon oil, a protective lacquer and a mineral oil.

5. The method according to claim 4, wherein the protective medium (22) is one which hardens after deposition.

6. The method according to claim 4, wherein the protective medium (22) is one which does not harden after deposition.

7. The method according to claim 4, wherein the protective medium (22) is optically transparent.

* * * * *